US005823757A

United States Patent [19]

Kim

[11] Patent Number: 5,823,757

[45] Date of Patent: Oct. 20, 1998

[54] AXIAL SEALING APPARATUS FOR SCROLL TYPE COMPRESSOR

[75] Inventor: Seon-Young Kim, Kyungki-Do, Rep. of Korea

[73] Assignee: LG Electronics Inc., Rep. of Korea

[21] Appl. No.: 765,647

[22] PCT Filed: May 2, 1996

[86] PCT No.: PCT/KR96/00064

§ 371 Date: Dec. 31, 1996

§ 102(e) Date: Dec. 31, 1996

[87] PCT Pub. No.: WO96/35056

PCT Pub. Date: Nov. 7, 1996

[30] Foreign Application Priority Data

May 2, 1995 [KR] Rep. of Korea ..... 1995/10723
Nov. 2, 1995 [KR] Rep. of Korea ..... 1995/39366

[51] Int. Cl.[6] ..... F04C 18/04

[52] U.S. Cl. ..... 418/55.5; 418/57

[58] Field of Search ..... 418/55.5, 57

[56] References Cited

U.S. PATENT DOCUMENTS 4,365,941 12/1982 Tojo et al. ..... 418/55.5
4,475,874 10/1984 Sato ..... 418/55.5
4,557,675 12/1985 Murayama et al. ..... 418/55.5
4,795,322 1/1989 Etemad et al. ..... 418/57
5,474,433 12/1995 Chang et al. ..... 418/57
5,482,450 1/1996 Caillat et al. ..... 418/55.5

*Primary Examiner*—John J. Vrablik
*Attorney, Agent, or Firm*—Ostrolenk, Faber, Gerb & Soffen, LLP

[57] ABSTRACT

An improved axial sealing apparatus for a scroll type apparatus which is capable of constantly maintaining pressure in a back pressure chamber by forming a back pressure hole at a predetermined portion in which the back pressure hole is opened before a compressed gas is discharged and the back pressure hole is closed after the compressed gas is substantially closed, whereby a more stable axial direction sealing can be obtained throughout the entire operation time of a scroll compressor, which includes a stationary scroll; a rotational scroll engaged at a lower portion of the stationary scroll so as to form a compression chamber therebetween; and a back pressure chamber having a back pressure hole formed at a predetermined position in which the back pressure hole is opened whereby the compression chamber and the back pressure chamber become communicated with each other before a refrigerant gas compressed in the compression chamber is discharged to the discharging chamber and in which the back pressure hole is closed after the refrigerant gas is discharged to the discharging chamber, whereby an intermediate pressure having a greater pressure than the suction gas pressure and having a lower pressure than the discharging gas pressure is introduced into the back pressure chamber.

2 Claims, 7 Drawing Sheets

AXIAL SEALING APPARATUS FOR SCROLL TYPE COMPRESSOR

TECHNICAL FIELD

The present invention relates to an axial sealing apparatus for a scroll type compressor, and particularly to an improved axial sealing apparatus for a scroll type compressor which is capable of constantly maintaining pressure in a back pressure chamber by forming a back pressure hole at a predetermined portion in which the back pressure hole is opened before a compressed gas is discharged and the back pressure hole is closed after the compressed gas is substantially closed, whereby a more stable axial direction sealing can be obtained throughout the entire operation time of a scroll compressor.

BACKGROUND ART

FIG. 1 shows a conventional scroll type compressor, which includes a compression mechanism section 30 provided at an inner upper portion of a compressor main body 1 and a motor mechanism section 40 provided at an inner lower portion of the same.

The compression mechanism section 30 includes a stationary scroll 2, a rotational scroll 3 engaged to a lower portion of the stationary scroll 2 so as to define a compression chamber therebetween, and a main frame 4 positioned at a lower portion of the rotational scroll 3 and directed to supporting the stationary scroll 2.

Here, as shown in FIG. 2, the stationary scroll 2 is movable toward the direction of a rotary shaft 5 in a state that the stationary scroll 2 is engaged to a leaf spring 11 engaged to the main frame 4 in cooperation with a bolt 12.

Meanwhile, the motor mechanism section 40 includes a rotor 6 tightly inserted onto the rotary shaft 5, and a stator 7 spaced apart from the outer surface of the rotor 6.

The rotary shaft 5 is rotated in cooperation with a electromagnetic operation between the stator 7 and the rotor 6.

Meanwhile, the upper portion of the rotary shaft 5 is eccentrically engaged with the rotational scroll 3.

In the drawings, reference numeral 8 denotes an oldham coupling which serves to prevent a rotation of a rotational scroll 3, and 10 denotes a suction tube through which a refrigerant gas is introduced.

The conventional scroll type compressor is directed to introducing a refrigerant gas sucked thereto from the suction tube 10 into the interior of two new-moon-shaped compression chambers 25 and 26 which are defined between the rotational scroll 3 and the stationary scroll 2 as shown in FIGS. 3A through 3C when the rotational scroll 3 is rotated.

Continuously, the volume of the compression chambers 25 and 26 is decreased, and then the refrigerant gas is compressed as the refrigerant gas flows toward the center of the compression chambers 25 and 26.

At this time, in a built-in type scroll compressor in which a discharge operation is performed a predetermined volume is obtained without valve during a discharge cycle of a refrigerant gas, when both end portions of two compression chambers 25 and 26 come into hermetic contact with each other as the rotational scroll 3 is rotated, a discharging hole 15 is opened and then the compressed refrigerant gas is discharged therethrough.

Therefore, in the scroll compressor which is generally operated under various operating conditions, when the pressure of gas which is compressed until the discharge starts is higher than the discharge pressure, the discharge occurs. But, when the pressure of gas which is compressed until the discharge starts is lower than the discharge pressure, the gas is reversely flown into the compression chambers 25 and 26, so that the pressure in the compression chambers 25 and 26 is sharply increased, and then becomes higher than the discharge pressure.

Therefore, as shown in FIG. 4B, various compression curves are obtained in accordance with a predetermined operating condition.

Meanwhile, during the compression process of the conventional scroll compressor, refrigerant gas leakage occurs. The leakage is generally classified into two parts. Of which, one is referred to a tangential direction leakage which occurs in a tangential direction about side surface of a scroll wrap 2' of the stationary scroll 2 and the scroll wrap 3' of the rotational scroll 3 as shown in FIG. 2. Of which the other is referred to a radial direction leakage which occurs at an end portion of the scroll wraps 2' and 3' in an involt curve due to an axial direction gap between the stationary scroll 2 and the rotational scroll 3.

Of the above-explained two leakages, the latter leakage makes a more serious problems in deciding efficiency rate of the compressor because the leakage occurs a lengthy-wise direction.

Therefore, so as to prevent the above-mentioned axial direction leakage, an axial direction sealing apparatus for a scroll compressor was introduced in the industry, which is directed to forming a back pressure chamber 13 at a rear side of the stationary scroll 2 or the rotational scroll 3, and thereby introducing compressed gas discharged from the compression chambers 25 and 26 and pushing the stationary scroll 2 toward the rotational scroll 3 in cooperation with a pressure of the compressed gas.

In the construction for sealing an axial direction gas leakage using the pressure of gas, an applying force is proportional to the pressure and the operating area of gas, and since the operating area is constant, the force varies in accordance with pressure variations.

However, the compressor is operated within a trapezoidal-shaped area as shown in FIG. 4A, various conditions are necessary for the compressor.

That is, since the suction pressure and discharge pressure are varied in accordance with the variation of the temperature of evaporator, and condenser, the pressure of the gas which is being compressed varies.

Therefore, so as to obtain a stable axial direction sealing force, when the pressure of gas applying to the back surface of the scroll reaches ½ of the pressure of gas in the compression chamber, the axial direction sealing force becomes constant under any operating conditions.

However, in the built-in-volume type compression in which valve is not provided, since the compressor has a similar compression process before the discharge start angle under any pressure conditions, and then has various types of compression processes as shown in FIG. 4B in accordance with a given discharge pressure, an average pressure between before the discharge start and after the discharge start for a predetermined pressure which is ½ of the gas pressure in the compression chamber at the back side of the scroll should be applied to the back pressure chamber, so that it is possible to accurately apply a half of the pressure.

Therefore, in the conventional art, it is necessary to provide a predetermined construction that forms a back pressure hole 24 by which a predetermined gas pressure of which the level is close to the suction pressure is applied to the scroll back surface so that the discharge pressure and the suction pressure are properly distributed. When applying the gas pressure to the scroll back surface, it is necessary to increase the back pressure surface, so that there is always high applying force irrespective of the operating condition.

That is, in more detail, as shown in FIG. 2, the axial direction sealing apparatus for a conventional scroll compressor is directed to preventing an axial direction gas leakage by forming a back pressure chamber 13 at a rear side of the stationary scroll 2, introducing the refrigerant gas having an intermediate level of pressure which is obtained during a compression cycle of the system into the back pressure chamber 13 through the back pressure hole 14 formed at a predetermined portion of the stationary scroll 2, receiving a cooperation effect between the pressure of the back pressure chamber gas and a gas pressure which is generated by the gas compressed and discharged from the compression chamber, and moving the stationary scroll 2 toward the rotational scroll 3.

In addition, there is another type of the axial direction sealing apparatus for a conventional scroll compressor, which is forming a back pressure chamber at a rear side of the rotational scroll.

That is, another axial direction sealing apparatus for a conventional scroll compressor is directed to preventing an axial direction leakage of a compressed gas by introducing a refrigerant gas having a predetermined pressure and compressed within the compression chamber into the back pressure chamber formed at a predetermined portion of the rotational scroll and properly controlling the pressure difference between the intermediate level of the compressed gas and a pressure which is obtained by the gas compressed within and discharged from the compression chamber.

In the above-mentioned construction of an axial direction sealing apparatus for a conventional scroll compressor, a gas pressure in the back pressure chamber 13 is referred to an average gas pressure between a gas pressure at the moment when the back pressure hole 14 starts to be opened and a gas pressure at the moment when the back pressure hole 14 starts to be closed.

At this time, as shown in FIG. 4B, the back pressure hole 14 of the axial direction sealing apparatus for a conventional scroll compressor is closed at the moment when the compression chamber and the discharging hole 15 communicate with each other, that is, it is closed before the discharge start time.

In the construction that is directed to preventing leakage in an axial direction concurrently using pressure in the back pressure chamber 13 and discharging pressure, it is necessary to increase the area of the back pressure chamber 13 so as to add pressure of the discharging gas without changing the position of the back pressure chamber 13. That is, as shown in FIG. 4C, it is possible to obtain an axial direction sealing force which greatly varies under a different operation condition.

In this case, the sealing force "F" of an axial direction is as follows:

$$F=(Pb-Po)Ab-(Pc-Po)Ac \quad \text{--- formula I}$$

where Pb denotes the pressure of a back pressure chamber, Po denotes the pressure of a suction gas, Pc denotes the pressure of a compression chamber, Ab denotes the area of a back pressure chamber, and Ac denotes the area of a compression chamber.

In addition, the back pressure Pb is not greatly changed in accordance with the pressure of the compression chamber since the diameter of the back pressure hole is very small, and becomes an average pressure of the compression chamber, the following expression is obtained, assuming that the above-mentioned process is referred to a constant-heat compression process ($PV^K$=constant).

$$Pb=Po[(V_0/V_2)^K+(V_0/V_2)^K/2 \quad \text{--- formula II}$$

where subscript reference numeral 1 denotes the moment when the back pressure hole 14 is opened, and subscript reference numeral 2 denotes the moment when the back pressure hole 14 is closed. As is well known relative to mathematical formulas, the subscript "o" denotes the moment when the refrigerant gas is introduced.

Therefore, as is expressed in the formula II, since the pressure Pb in the back pressure chamber is changed in accordance with a change of the suction gas pressure, it is difficult to obtain a more stable sealing force under an operating condition having various discharging pressures compared with the suction pressure as shown in FIG. 4B.

Here, the sealing force "F" should be substantially great so as to maintain a minimum axial direction gap between the stationary scroll 2 and the rotational scroll 3. However, when the gap is too great, since friction loss between the stationary scroll 2 and the rotational scroll 3 is increased, a proper weight should be provided therein.

In addition, since the sealing force "F" concurrently receives a discharging gas pressure and an intermediate gas pressure, it is important to properly distribute two pressures applied thereto.

In more detail, since the discharging gas has a high pressure, when the compression ratio is high, the force at a unit area is very great with respect to the same area.

Meanwhile, since the intermediate pressure applied from the compression chamber is referred to an average pressure between a pressure when the compression chamber and the back pressure chamber are opened and the same are closed, there is not a rapid change in accordance with the compression ratio.

Therefore, in the construction using the discharge pressure and intermediate pressure, as shown in FIG. 4C, when computing a sealing force based on the operation condition of the scroll compressor, the sealing force is increased when the discharging pressure is the highest.

Since the discharging gas pressure is further applied in the conventional art, there is substantial difference in accordance with a compression ratio. In addition, since it is impossible to generate a more stable sealing force under various compression ratios of the operating conditions, the efficiency is degraded.

In addition, when over compression occurs in the compression chamber, gas leakage is increased in the compression chamber due to high pressure therein, thus causing friction of parts of the compressor, whereby reliability of the system is degraded.

Meanwhile, in the axial direction sealing apparatus for another conventional scroll type compressor, as shown in FIG. 4A, an axial direction sealing force is greatly varied in accordance with changes of the suction gas pressure as shown in FIG. 4C under various compressor operation conditions.

That is, in this case, the timing of opening/closing of the back pressure hole 14 is an important factor. As shown in FIGS. 3A and 3C, since the back pressure hole 14 of the conventional compressor communicates with the compression chamber having a lower compression gas pressure, when the intermediate compression gas pressure is operated before the discharge start, the axial direction leakage prevention force is based on a function of the suction gas pressure. When the suction gas pressure is low, the leakage prevention force is low. On the contrary, when the suction gas pressure is high, the leakage prevention force becomes high.

Therefore, the leakage prevention force become unstable in accordance with an operating condition.

DISCLOSURE OF THE INVENTION

Accordingly, it is an object of the present invention to provide an axial sealing apparatus for a scroll type apparatus, which overcomes the problems encountered in a conventional axial sealing apparatus for a scroll type apparatus.

It is another object of the present invention to provide an improved axial sealing apparatus for a scroll type apparatus which is capable of constantly maintaining pressure in a back pressure chamber by forming a back pressure hole at a predetermined portion in which the back pressure hole is opened before a compressed gas is discharged and the back pressure hole is closed after the compressed gas is substantially closed, whereby a more stable axial direction sealing can be obtained throughout the entire operation time of a scroll compressor. That is, the back pressure hole is open before compressed gas is discharged, and the back pressure hole is closed after compressed gas is discharged.

To achieve the above objects, there is provided an apparatus for axially sealing a scroll type compressor, which includes a stationary scroll; a rotational scroll engaged at a lower portion of the stationary scroll so as to form a compression chamber therebetween; and a back pressure chamber having a back pressure hole formed at a predetermined position in which the back pressure hole is opened whereby the compression chamber and the back pressure chamber become communicated with each other before a refrigerant gas compressed in the compression chamber is discharged to the discharging chamber and in which the back pressure hole is closed after the refrigerant gas is discharged to the discharging chamber, whereby an intermediate pressure having a greater pressure than the suction gas pressure and having a lower pressure than the discharging gas pressure is introduced into the back pressure chamber.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

MODES FOR CARRYING OUT THE INVENTION

Figure 5:
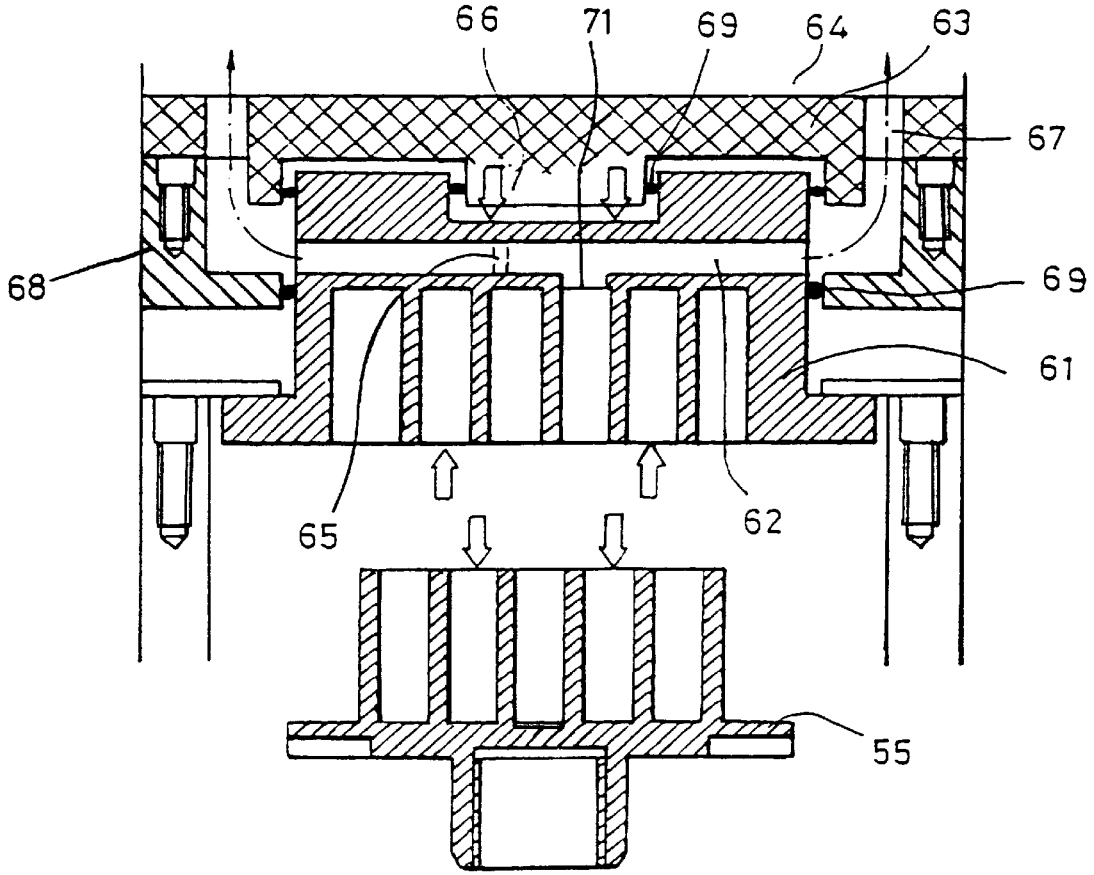
FIG. 5 is a schematic view showing a back pressure formation in a scroll compressor according to the present invention.
Figure 6A:
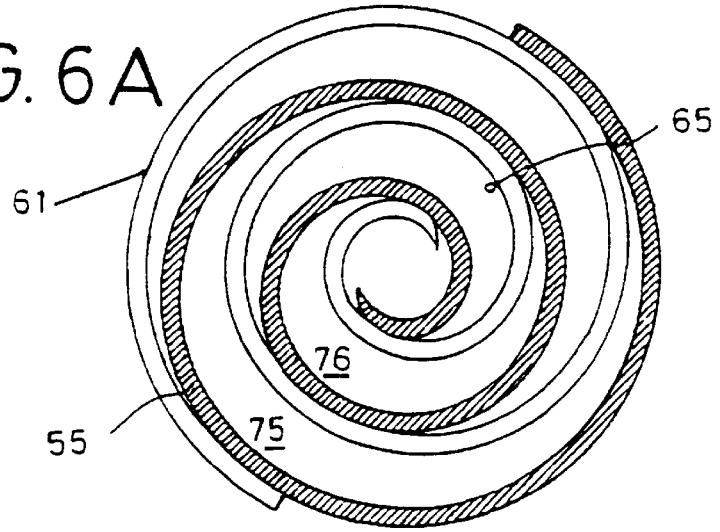
FIG. 6A is a top view of an axial direction sealing apparatus of a scroll type compressor according to the present invention so as to show a position of a back pressure hole and a state that a suction operation of a refrigerant gas is finished.
Figure 6B:
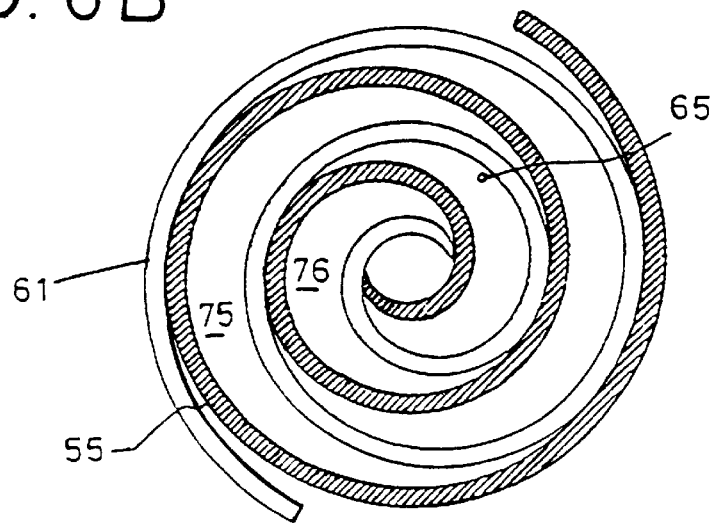
FIG. 6B is a top view of an axial direction sealing apparatus of a scroll type compressor according to the present invention so as to show a position of a back pressure hole and a state just before a refrigerant gas starts to be discharged.
Figure 6C:
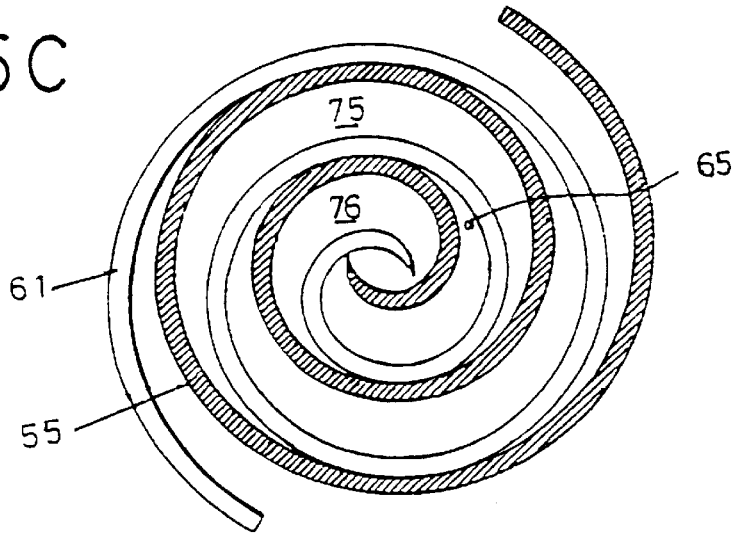
FIG. 6C is a top view of an axial direction sealing apparatus of a scroll type compressor according to the present invention so as to show a position of scrolls and a position of a compression chamber according to the present invention.

Referring to FIGS. 5 and 6, the axial direction sealing apparatus for a scroll type compressor according to the present invention includes a discharging path 62 communicating with a discharging hole 71, through which a compressed refrigerant gas is discharged, formed in the interior of a stationary scroll 61.

The discharging path 62 is connected to the upper portion of the stationary scroll 61, and a discharging chamber 64 is provided by spacing apart from the stationary scroll 61 about an upper partition 63.

In addition, a back pressure chamber 66 is formed between the stationary scroll 61 and the upper partition 63, and an intermediate pressure is applied to back pressure chamber 66 from the compression chambers 75 and 76 by means of a back pressure hole 65 formed at the stationary scroll 61.

A discharging hole 67 is formed at both sides of the upper partition 63 so that a compressed refrigerant passed through the discharging path 62 formed in the interior of the stationary scroll 61 can be discharged into the discharging chamber 64.

Meanwhile, an assistant frame 68 is disposed between the discharging path 62 of the stationary scroll 61 and the discharging hole 67 of the upper partition 63 for guiding refrigerant gas.

This embodiment of the present invention is directed to basically moving the position of a back pressure hole 65 for guiding pressure of the compression chambers 75 and 76 toward the back pressure chamber 66 formed at the back portion of the stationary scroll 61 toward an inner-wise portion of the stationary scroll 61 for opening/closing the compression chambers 75 and 76 before/after the discharging of the compressed refrigerant gas, so that pressure having a predetermined level higher than the suction gas pressure and lower than the discharging gas pressure can be applied to the back pressure chamber 66.

Figure 1:
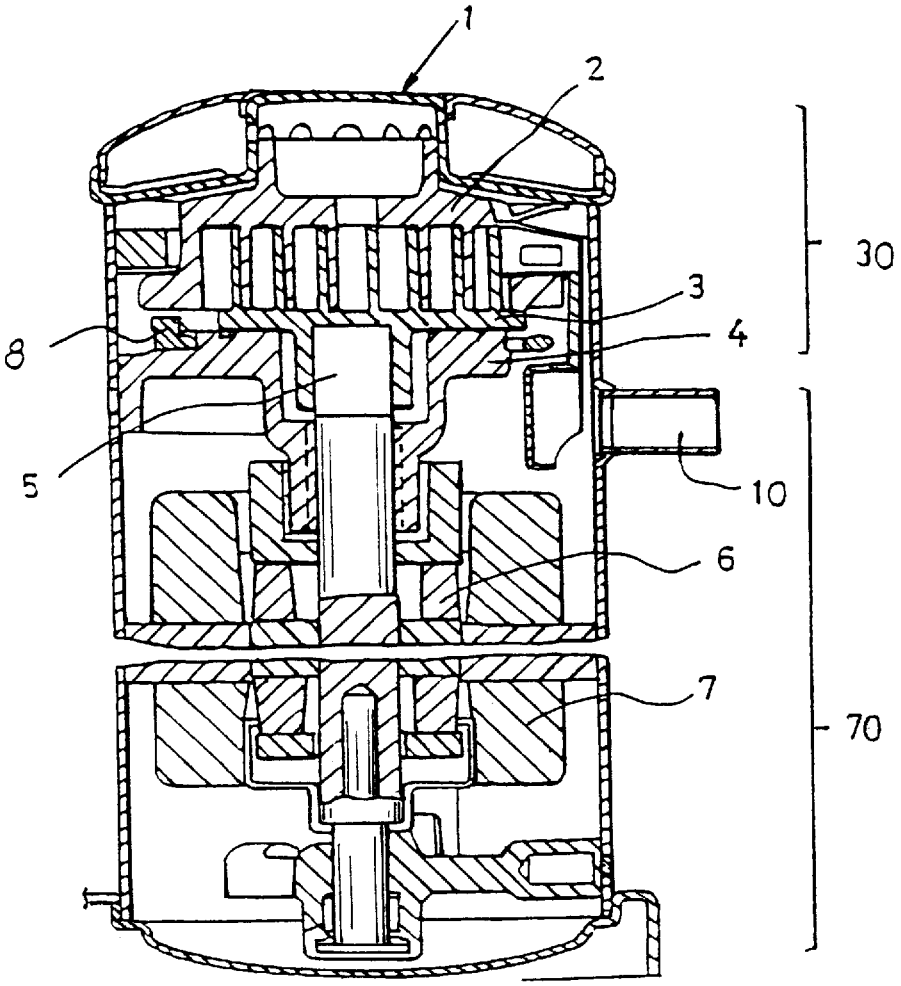
FIG. 1 (PRIOR ART)
FIG. 1 is a vertical cross-sectional view of a conventional scroll type compressor.
Figure 2:
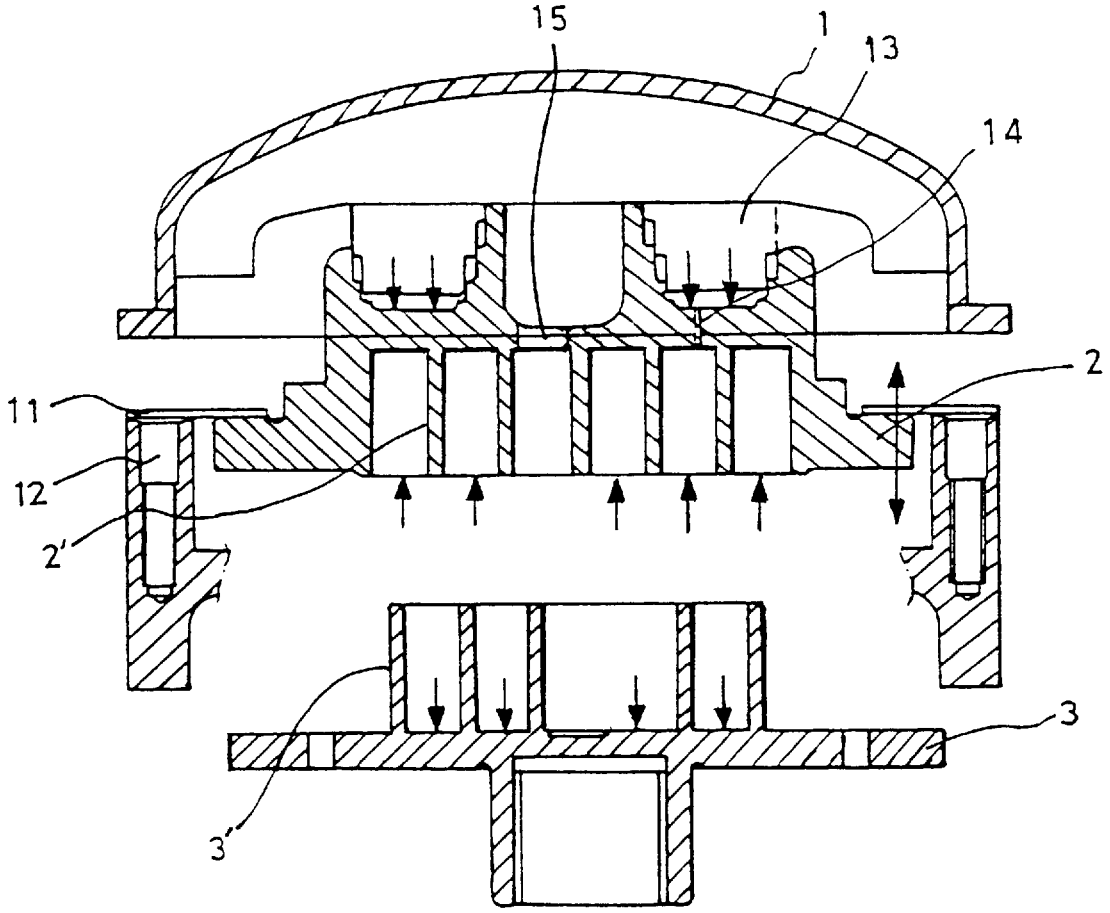
FIG. 2 (PRIOR ART)
FIG. 2 is a cross-sectional view of an axial direction sealing apparatus for a conventional scroll type compressor so as to show the axial direction operation of a pressure of the apparatus.
Figure 3A:
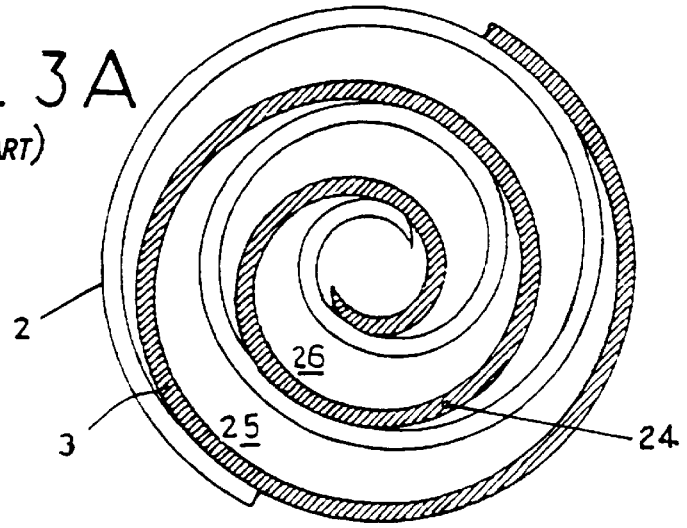
FIG. 3A (PRIOR ART)
FIG. 3A is a top view of a compression chamber so as to show a position of a back pressure hole of an axial direction sealing apparatus of a conventional scroll type compressor and a state that a suction operation of a refrigerant gas is finished.
Figure 3B:
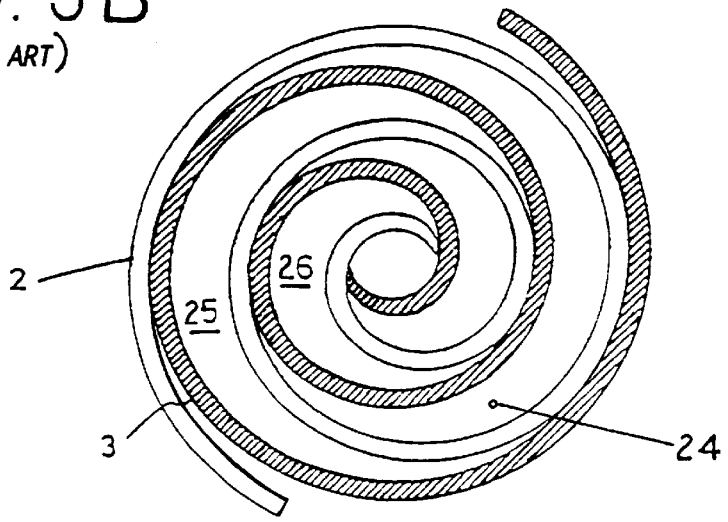
FIG. 3B (PRIOR ART)
FIG. 3B is a top view of a compression chamber so as to show a position of a back pressure hole of an axial direction sealing apparatus of a conventional scroll type compressor and a state just before a refrigerant gas starts to be discharged.
Figure 3C:
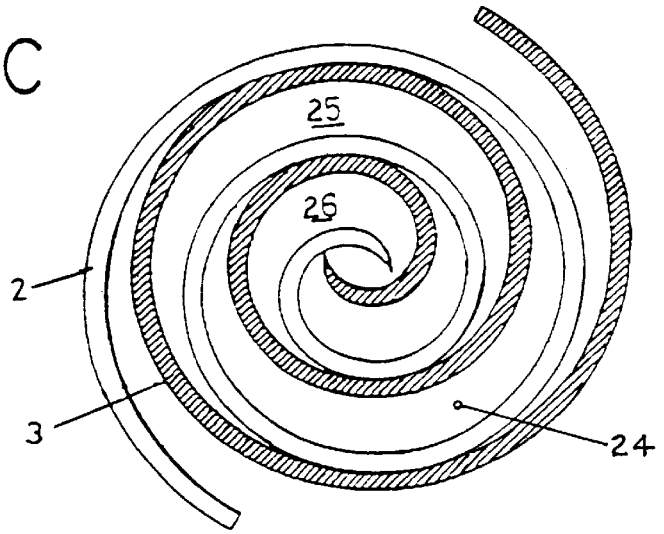
FIG. 3C (PRIOR ART)
FIG. 3C is a top view of the shape of scrolls and a compression chamber of a process during which a refrigerant gas of an axial direction sealing apparatus for a conventional scroll type compressor is discharged.
Figure 4A:
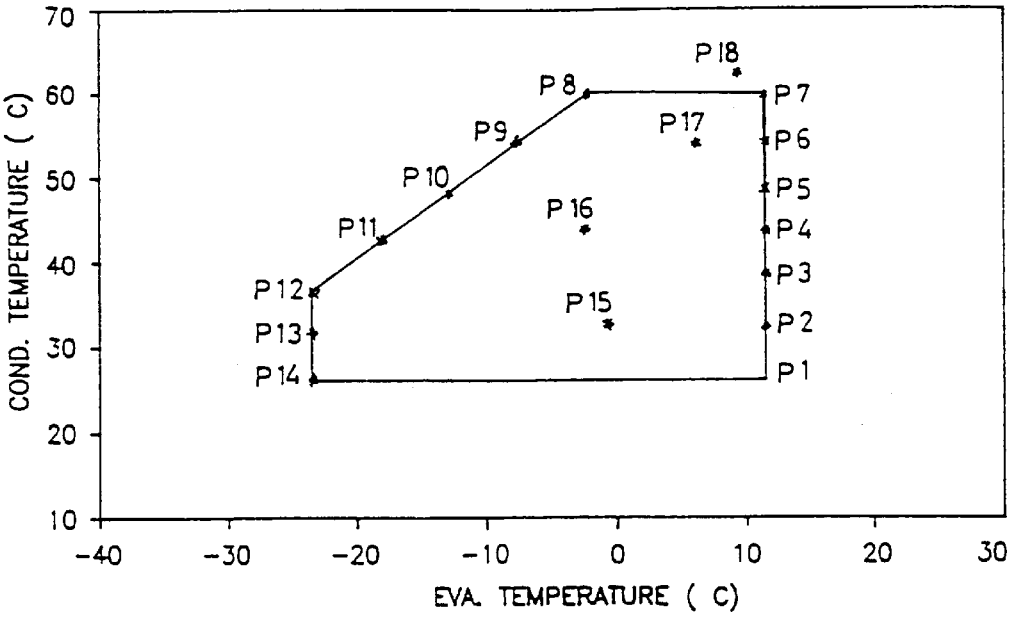
FIG. 4A (PRIOR ART)
FIG. 4A is a graph so as to show an operating condition of a conventional scroll type compressor.
Figure 4B:
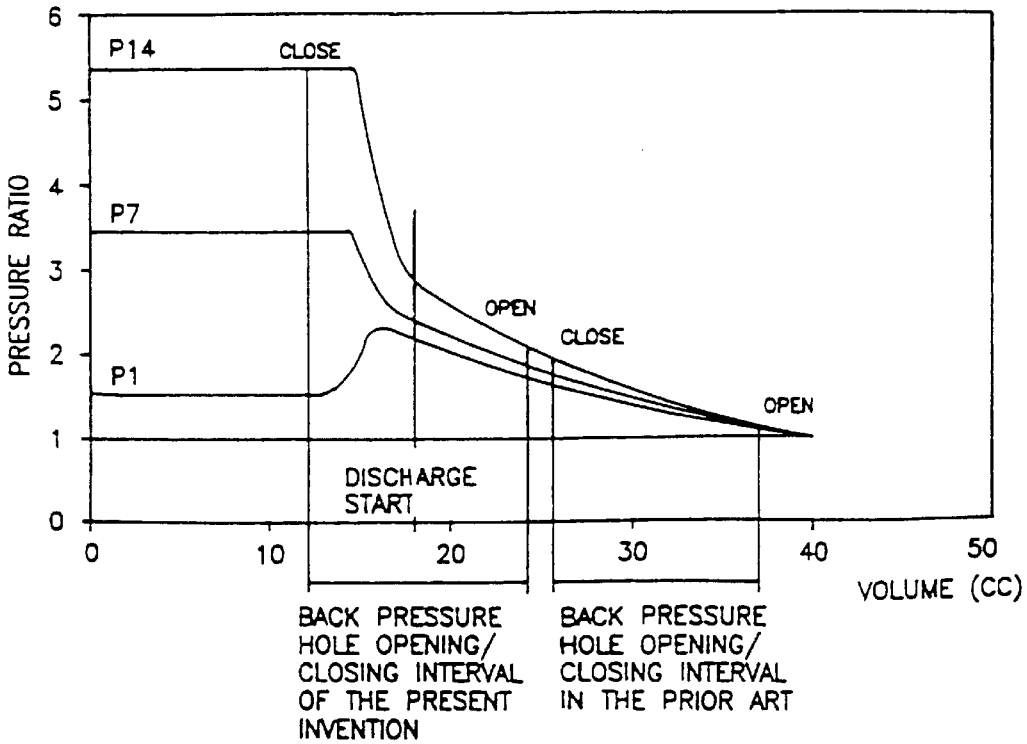
FIG. 4B is a graph so as to show a PV-diagram and an opening/closing interval of a back pressure hole in accordance with an operating condition of P1, P7, and P14 among the operating conditions FIG. 4A.
Figure 4C:
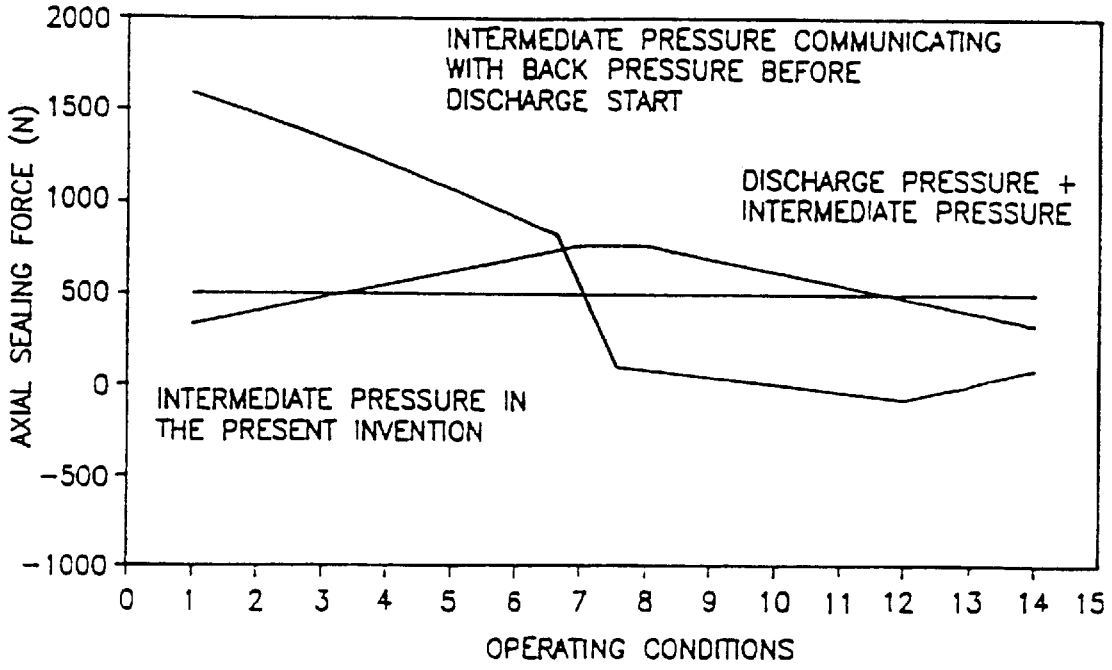
FIG. 4C is a graph so as to show a discharge pressure+intermediate pressure construction, an intermediate pressure construction with witch a back pressure hole communicates before the discharge start, and an axial direction sealing force of the construction adapting an intermediate pressure of FIG. 4A according to the present invention.

That is, as shown in FIG. 4, the moment when the compression chambers 75 and 76 and the back pressure chamber 66 start to communicate with each other is referred to the communication therebetween before the compressed refrigerant gas is discharged and the closing operation therebetween after the compressed refrigerant gas is discharged.

Meanwhile, in another embodiment of the present invention, the back pressure chamber 66 and the back pressure hole 65 may be formed at a rotational scroll 55, not at the stationary scroll 61.

In detail, the back pressure chamber 66 is formed at the back side of the rotational scroll 55, and the back pressure hole 65 may be formed at the rotational scroll 55 so that the compression chambers 75 and 76 and the back pressure chamber 66 formed at the back side of the rotational scroll 55 cause to open/close the back pressure hole 65.

At this time, since the diameter of the back pressure hole 65 is relatively small compared to the area of the back pressure chamber 66, the gas pressure of the back pressure chamber 66 does not vary in accordance with the pressure of the compression chambers 75 and 76, and the pressure of the back pressure hole 65 upon opening/closing becomes an average pressure between the compression chambers 75 and 76.

When enlarging the diameter of the back pressure hole 65, the pressure of the compression chambers 75 and 76 is directly applied to the back pressure chamber 66, and when the pressure of the compression chambers 75 and 76 is low, the pressure of the back pressure chamber 66 is low, and when the pressure of the compression chambers 75 and 76 is high, the pressure of the back pressure chamber 66 is high, thus obtaining a more stable leakage prevention force.

The operation and effects of the axial direction sealing apparatus for a scroll compressor according to one embodiment of the present invention will now be explained with reference to the accompanying drawings.

When the refrigerant gas is compressed in cooperation with the rotation of the rotational scroll 55 in the compression chambers 75 and 76 formed by the stationary scroll 61 and the rotational scroll 55, the opening/closing operation of the back pressure hole 65 so as to prevent leakage of gas is performed before/after the gas compressed by the compression chambers 75 and 76 starts to be discharged.

Therefore, the pressure of the gas applied to the back pressure chamber 66 has an average pressure value between the suction gas pressure and the discharging gas pressure.

In detail, under various operating conditions, that is, when the compression states of the suction gas and the discharge gas are different, a more stable leakage prevention force corresponding to an operating condition given is formed at the back pressure chamber 66, whereby a more stable axial direction leakage prevention of a scroll compressor can be achieved.

In addition, the discharging gas is discharged from the discharging hole 71, and then introduced in leftside and rightside directions through the discharging path 62 formed at the intermediate portion of the back pressure chamber 66 and the compression chambers 75 and 76, and then introduced to the discharging hole 67 formed at the upper partition through a hermetic space which is formed between the upper partition 63, the assistant frame 68, and a sealing material 69.

Therefore, the discharge gas is directly applied to the upper portion above the discharging hole 67. When reducing the size of the discharging hole 67, since it is possible to reduce applying weight compared to the conventional art and the stationary scroll 61 does not receive any influence in its up/down movements, only the intermediate pressure of the back pressure chamber 66 is applied to the upper portion of the stationary scroll 61, whereby an intermediate pressure and back pressure construction which is directed to downwardly and more stably pushing the stationary scroll 61 can be achieved.

As described above, the axial direction sealing apparatus for a scroll type compressor according to the present invention is directed to obtaining a more stable gas leakage prevention force under various operating conditions by providing an improved back pressure hole which communicates with the compressed gas having high pressure after the discharging start angle is passed, whereby only an intermediate gas pressure between a discharge gas pressure and a suction gas pressure is applied in the back pressure chamber. In addition, when an over compression occurs, when the pressure of the discharge gas is increased, the leakage prevention force is increased together with the increase of the discharge gas, thus preventing efficiency loss of the compressor and friction of the system, whereby reliability of compressor can be increased.

Although the preferred embodiments of the present invention have been disclosed for illustrative purposes, those skilled in the art will appreciate that various modifications, additions and substitutions are possible, without departing from the scope and spirit of the invention as described in the accompanying claims.

I claim:

1. An axial sealing apparatus for a scroll type compressor, comprising:

a stationary partition;

a stationary scroll adjacent said stationary partition;

a rotational scroll engaged with the stationary scroll so as to form a compression chamber therebetween;

a back pressure chamber formed between said stationary partition and the stationary scroll and having a back pressure hole communicating with the compression chamber and formed at a predetermined position where the back pressure hole is opened before a refrigerant gas compressed in the compression chamber is discharged to a discharging chamber for communicating the compression chamber and the back pressure chamber with each other and which back pressure hole is closed after the refrigerant gas is discharged to the discharging chamber; and discharging holes communicating with the compression chamber and formed through the stationary scroll between the compression chamber and the back pressure chamber and opening at the sides of the stationary scroll for discharging the discharged gas from the compression chamber to the sides of the stationary scroll so that the stationary scroll is not axially loaded by the discharged gas, whereby an intermediate pressure having a greater pressure than a suction gas pressure and having a lower pressure than a discharging gas pressure is introduced into and maintained in the back pressure chamber.

2. The apparatus of claim 1, wherein said back pressure hole is formed at the stationary scroll, and said back pressure chamber is formed at the upper portion of the stationary scroll.

* * * * *